US009031479B2

(12) United States Patent
Shirakata et al.

(10) Patent No.: US 9,031,479 B2
(45) Date of Patent: May 12, 2015

(54) IMAGE FORMING APPARATUS INCLUDING TRANSFER BELT

(71) Applicant: Canon Kabushiki Kaisha, Tokyo (JP)

(72) Inventors: Jiro Shirakata, Chigasaki (JP); Keitaro Taoka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 83 days.

(21) Appl. No.: 13/674,213

(22) Filed: Nov. 12, 2012

(65) Prior Publication Data

US 2013/0129394 A1 May 23, 2013

(30) Foreign Application Priority Data

Nov. 18, 2011 (JP) ..... 2011-253136
Oct. 31, 2012 (JP) ..... 2012-241107

(51) Int. Cl.
*G03G 15/01* (2006.01)
*G03G 15/00* (2006.01)
*G03G 15/16* (2006.01)

(52) U.S. Cl.
CPC ..... *G03G 15/0189* (2013.01); *G03G 15/1615* (2013.01); *G03G 2215/00156* (2013.01); *G03G 2215/00168* (2013.01)

(58) Field of Classification Search
USPC ..... 399/301, 165
See application file for complete search history.

(56) References Cited

U.S. PATENT DOCUMENTS 8,045,904 B2 10/2011 Shirakata
8,855,514 B2 10/2014 Shirakata
2009/0087231 A1 4/2009 Masaki et al.
2011/0097095 A1* 4/2011 Shirakata ..... 399/49
2013/0058687 A1 3/2013 Shimizu et al.
2013/0078011 A1 3/2013 Shirakata

FOREIGN PATENT DOCUMENTS

CN 102043365 A 5/2011
JP 3-288167 A 12/1991
JP 2002-287527 A 10/2002
JP 2009-25626 A 2/2009
JP 2010-204255 A 9/2010
JP 2011-107696 A 6/2011

OTHER PUBLICATIONS

Chinese Office Action dated Nov. 24, 2014, in Chinese Patent Application No. 201210464420.6 (with English translation).

* cited by examiner

*Primary Examiner* — David Gray
*Assistant Examiner* — Rodney Bonnette
(74) *Attorney, Agent, or Firm* — Fitzpatrick, Cella, Harper & Scinto

(57) ABSTRACT

An image forming apparatus includes an image forming unit, a belt position detection unit to detect a position of a transfer belt in a rotating shaft direction of a driving roller, and a roller driving unit to tilt a steering roller to control the position of the transfer belt in the rotating shaft direction of the driving roller. In addition, a storage unit stores a reference position of the steering roller and a reference position of the transfer belt, and a control unit controls a formation position of the latent image, in a rotation axis direction of each photosensitive member, formed on each of a plurality of photosensitive members by the image forming unit based on a position of the transfer belt, in the rotating shaft direction of the driving roller, with respect to a detected reference position of the transfer belt and a tilt amount of the steering roller controlled by the roller driving unit with respect to the reference position of the steering roller.

7 Claims, 15 Drawing Sheets

FIG. 9

| | DIFFERENCE BETWEEN STEERING CAM PHASE AND TILT AMOUNT REFERENCE VALUE (degree) | | | | | | | | | |
|---|---|---|---|---|---|---|---|---|---|---|
| | -90 | -80 | ... | -10 | 0 | 10 | ... | 80 | 90 |
| DIFFERENCE BETWEEN BELT POSITION AND BELT POSITION REFERENCE VALUE (mm) | | | | | | | | | |
| -2 | -25 | -20 | | 15 | 20 | 25 | | 60 | 65 |
| -1.5 | -30 | -25 | | 10 | 15 | 20 | | 55 | 60 |
| ... | ... | ... | | ... | ... | ... | | ... | ... |
| 0 | -45 | -40 | | -5 | 0 | 5 | | 40 | 45 |
| ... | ... | ... | | ... | ... | ... | | ... | ... |
| 1.5 | -60 | -55 | | -20 | -15 | -10 | | 25 | 30 |
| 2 | -65 | -60 | | -25 | -20 | -15 | | 20 | 25 |

MODIFICATION VALUE OF IMAGE POSITION CORRECTION VALUE IN MAIN SCANNING DIRECTION (μm)

| TIME (ms) | 0 | 0.25 | 0.5 | 0.75 | • • • |
|---|---|---|---|---|---|
| MOVING DIRECTION | -30 | -40 | -50 | -48 | • • • |

IMAGE FORMING APPARATUS INCLUDING TRANSFER BELT

BACKGROUND OF THE INVENTION

1. Field of the Invention

The present invention relates to an image forming apparatus represented by a copying machine, a printer, a printing press, or the like and, more particularly, to an image forming apparatus including an endless belt-shaped transfer belt facing a plurality of image carriers.

2. Description of the Related Art

Along with an increase in speed of image forming apparatuses, dominating arrangements employ a plurality of image carriers facing an endless belt-shaped transfer belt and parallelly execute the image forming processes of the respective colors. For example, toner images of the respective colors are transferred to a transfer belt that is an endless belt in a superimposed manner, and the superimposed toner images are at once transferred to a printing material. The endless belt loops over a plurality of rollers and is driven by these rollers. The endless belt shifts in a direction perpendicular to the moving direction due to the diametral accuracy of the rollers or the alignment accuracy between the rollers.

Japanese Patent Laid-Open No. 2002-287527 discloses an arrangement for controlling the belt shift by detecting a variation in the position of a belt end face and adjusting, in proportion to the detected variation, the tilt of an adjustment roller that is one of the rollers to loop the belt.

In the arrangement described in Japanese Patent Laid-Open No. 2002-287527, however, changing the tilt of the adjustment roller causes a variation in the main scanning direction, that is, the direction perpendicular to the direction in which the belt should move. This may lead to an increase in color misalignment.

SUMMARY OF THE INVENTION

The present invention provides an image forming apparatus that suppresses belt shift and also suppresses color misalignment in the main scanning direction.

According to one aspect of the present invention an image forming apparatus includes: an image forming unit including a plurality of image carriers, a belt driving unit configured to rotatably drive an endless transfer belt looping over a plurality of rollers including a steering roller and a driving roller, and an exposure unit configured to form a latent image on each of the plurality of image carriers, and configured to transfer, to the transfer belt, a toner image formed on each of the plurality of image carriers by developing, by a toner, the latent image formed by the exposure unit and transfer, to a printing material, the toner image transferred to the transfer belt, thereby forming an image on the printing material; a belt position detection unit configured to detect a position of the transfer belt in a rotating shaft direction of the driving roller; a roller driving unit configured to tilt the steering roller to control the position of the transfer belt in the rotating shaft direction of the driving roller; a storage unit configured to store data about a reference position of the steering roller; and a control unit configured to acquire data about a tilt amount of the steering roller tilted by the roller driving unit with respect to the reference position and control, in the rotating shaft direction of the driving roller based on the data about the tilt amount, a formation position of the toner image formed on each of the plurality of image carriers by the image forming unit.

Further features of the present invention will become apparent from the following description of exemplary embodiments with reference to the attached drawings.

BRIEF DESCRIPTION OF THE DRAWINGS

FIG. 9 is a view showing a table used to decide the modification value of an image position correction value according to an embodiment;

DESCRIPTION OF THE EMBODIMENTS (First Embodiment)

Figure 1:
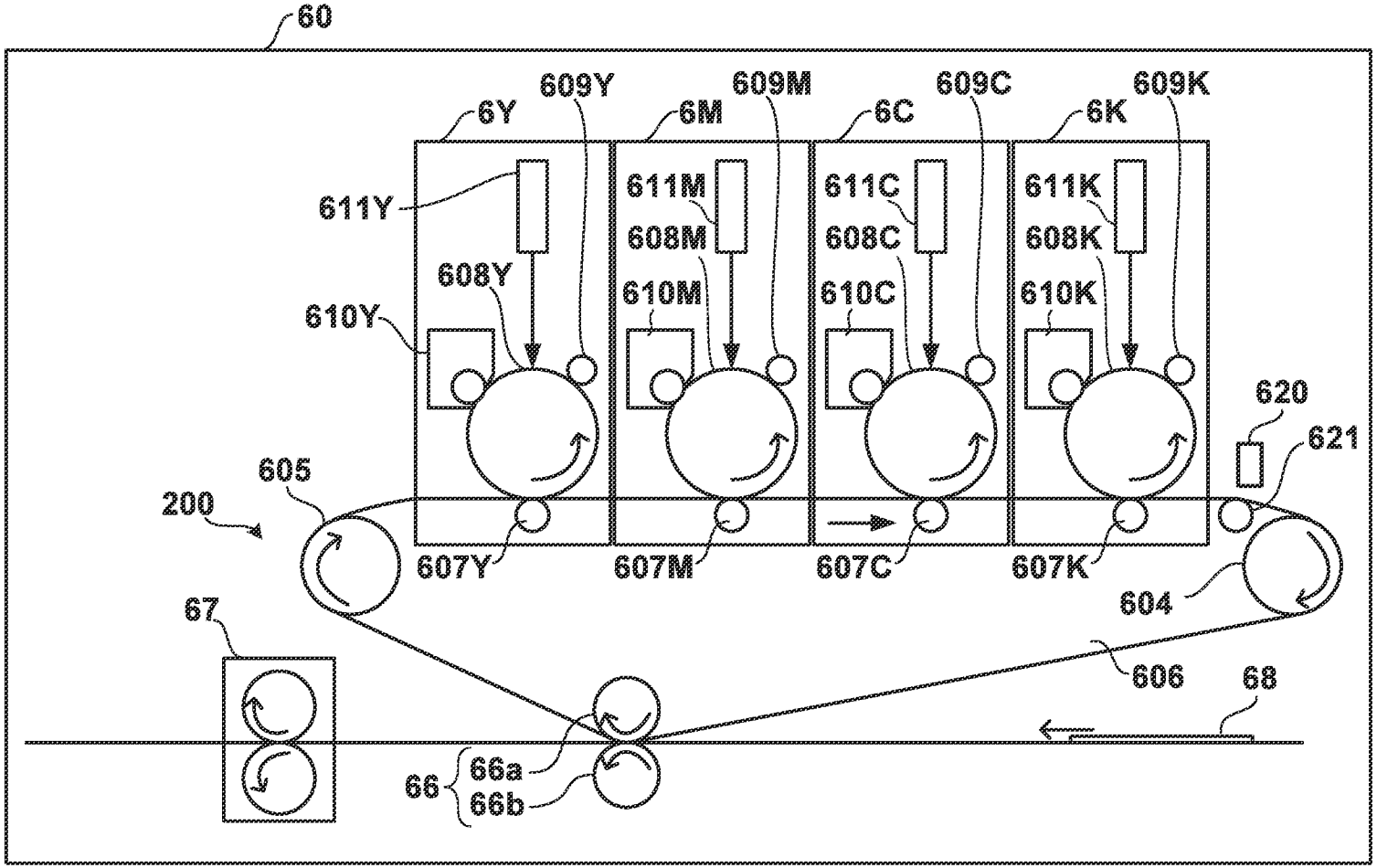
FIG. 1 is a view showing the image forming units of an image forming apparatus according to an embodiment.

An image forming apparatus can adopt various kinds of methods such as an electrophotographic method, an offset printing method, and an inkjet method. This embodiment will be described below using an electrophotographic image forming apparatus. FIG. 1 is a view showing the arrangement of an image forming apparatus 60 according to the present embodiment. Note that FIG. 1 illustrates only parts necessary for the explanation. An image forming unit 6Y configured to form a yellow toner image includes a photosensitive member 608Y serving as an image carrier, a charging device 609Y (transfer unit) that charges the surface of the photosensitive member 608Y, and an exposure device 611Y (exposure unit) that exposes the surface of the charged photosensitive member 608Y to form an electrostatic latent image. The image forming unit 6Y also includes a developing device 610Y (developing unit) that develops, by a toner, the surface of the photosensitive member 608Y with the electrostatic latent image, and a primary transfer device 607Y (primary transfer unit) that transfers the toner image on the photosensitive member 608Y to an intermediate transfer belt 606. Note that image forming units 6M, 6C, and 6K form magenta, cyan, and black toner images, respectively. They have the same arrangement as that of the image forming unit 6Y, and a description thereof will be omitted.

The toner images of the respective colors formed on the photosensitive members 608Y, 608M, 608C, and 608K provided in the image forming units 6Y, 6M, 6C, and 6K, respectively, are transferred to the intermediate transfer belt 606 by the primary transfer devices 607Y, 607M, 607C, and 607K provided in the image forming units 6Y, 6M, 6C, and 6K, respectively. When the toner images are transferred from the photosensitive members 608Y, 608M, 608C, and 608K, a full-color toner image is formed on the intermediate transfer belt 606. The toner image transferred to the intermediate transfer belt 606 is transferred by a secondary transfer device 66 (secondary transfer unit) to a printing material 68 conveyed in the conveyance path. The secondary transfer device 66 includes a transfer roller 66*b* to which a transfer bias is applied, and a counter roller 66*a* that forms a transfer nip portion together with the transfer roller 66*b*.

The toner image transferred to the printing material 68 is fixed by a fixing device 67 (fixing unit). In addition, a pattern detection sensor 620 configured to detect a pattern image formed on the intermediate transfer belt 606 in image position correction control is provided near the intermediate transfer belt 606.

Figure 2:
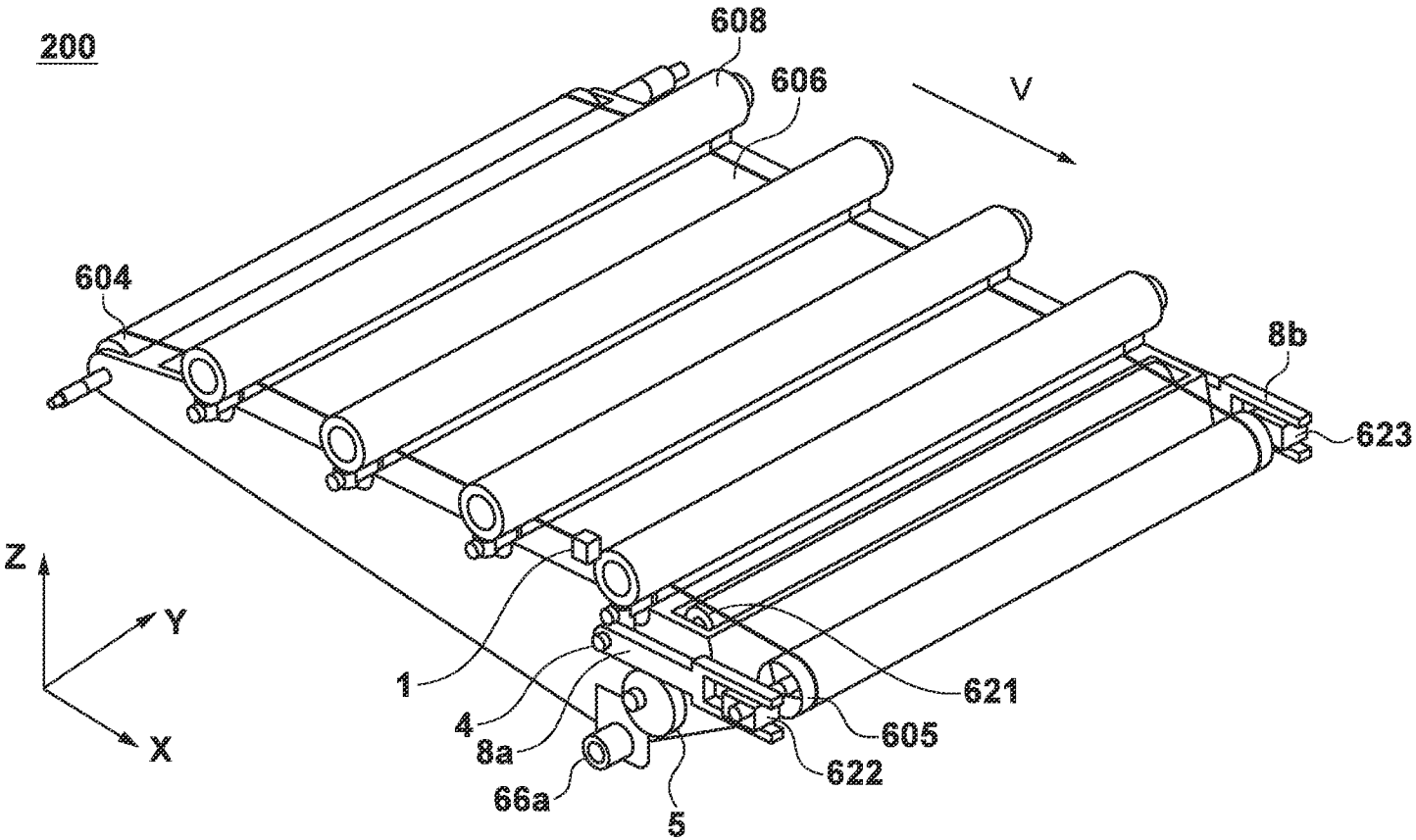
FIG. 2 is a perspective view showing the arrangement of an intermediate transfer belt unit according to an embodiment.

Details of an intermediate transfer belt unit 200 will be described next with reference to FIG. 2. The intermediate transfer belt unit 200 includes the intermediate transfer belt 606, a driving roller 604, the secondary transfer device 66, an idle roller 621, and a steering roller 605. The intermediate transfer belt unit 200 also includes a steering cam 5, a steering arm 8*a*, an arm 8*b*, bearings 622 and 623, a cam driving unit 701 (FIGS. 3 and 4), and an edge detection sensor 1. As shown in FIG. 2, the intermediate transfer belt 606 loops over a plurality of rollers including the driving roller 604, the secondary transfer roller 66*a*, the idle roller 621, and the steering roller 605. The intermediate transfer belt 606 uses the surface facing the photosensitive members 608 as a transfer surface to which a toner image is transferred, and is driven to move the transfer surface in the direction of an arrow V in FIG. 2. The bearings 622 and 623 for receiving the rotating shaft of the steering roller 605 are attached to the two ends of the steering roller 605 in the longitudinal direction. The bearing 622 is held by the steering arm 8*a*, and the bearing 623 is held by the arm 8*b*. The arm 8*b* is fixed to the main body of the image forming apparatus 60 or the frame (not shown) of the intermediate transfer belt unit 200. When the frame (not shown) of the intermediate transfer belt unit 200 is provided, the frame is fixed to the main body of the image forming apparatus 60.

The steering arm 8*a* is provided with a rotating shaft 4. The rotating shaft 4 provided in the steering arm 8*a* is rotatably attached to the main body of the image forming apparatus 60 or the frame (not shown) of the intermediate transfer belt unit 200. That is, at the end of the steering arm 8*a* on one side of the point of contact between the steering arm 8*a* and the cam surface of the steering cam 5 (to be described later), which is opposed to the side where the steering arm supports the bearing 622, the rotating shaft 4 is attached to the main body of the image forming apparatus 60 or the frame (not shown) of the intermediate transfer belt unit 200. Note that the steering arm 8*a* is configured to be biased toward the cam surface of the steering cam 5 by a biasing portion (not shown) including a spring and the like.

Figure 3:
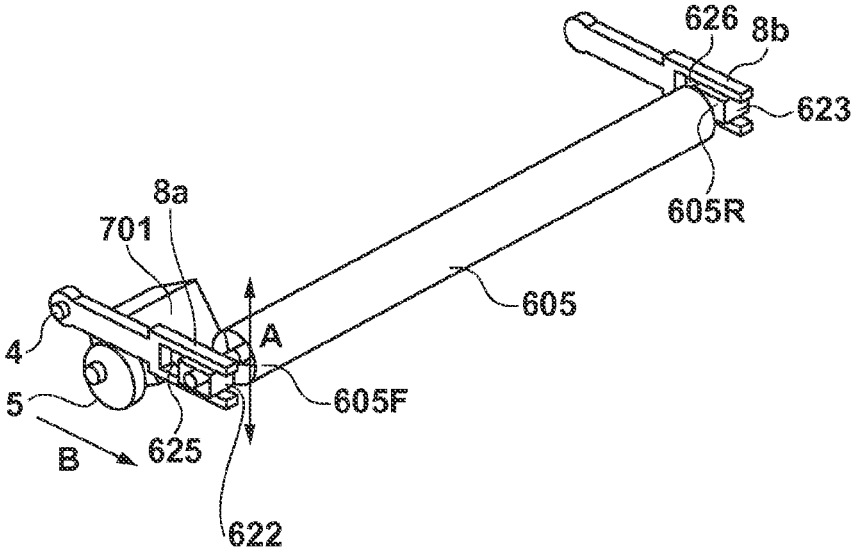
FIG. 3 is a perspective view showing a steering tilting mechanism according to an embodiment.

FIG. 3 is a perspective view showing details of a tilting mechanism that is a roller driving unit for tilting the steering roller 605 in a direction almost perpendicular to the transfer surface of the intermediate transfer belt 606. For example, the rotating shaft of the steering cam 5 is attached to the cam driving unit 701, as shown in FIG. 3. The cam driving unit 701 is a motor that rotates the steering cam 5. When the cam driving unit 701 rotates the steering cam 5, the steering arm 8*a* in contact with the cam surface swings about the rotating shaft 4 in the direction of an arrow A. This makes the steering roller 605 swing, which has, as a fixed end, an end 605R supported by the bearing 623. The image forming apparatus according to this embodiment adjusts the rotation amount of the steering cam 5 by the cam driving unit 701 (adjusts the rotation phase of the steering cam 5), thereby adjusting the tilt amount of the steering roller 605. The tiltable amount is decided by the cam profile of the steering cam 5 and its distances up to the rotating shaft 4 and the steering roller 605. The cam profile of the steering cam 5 and its distances up to the rotating shaft 4 and the steering roller 605 are decided from a value necessary for modifying transfer belt shift.

Note that in this embodiment, a spring 625 shown in FIG. 3 presses the bearing 622 in the direction of an arrow B, and a spring 626 presses the bearing 623 in the direction of the arrow B. For this reason, the steering roller 605 supported by the bearings 622 and 623 is in contact with the intermediate transfer belt 606. That is, the steering roller 605 also serves as a tension roller that prevents the intermediate transfer belt 606 looping over the plurality of rollers from bending. Note that the idle roller 621 is provided to suppress a variation in the area of the nip portion between the photosensitive member 608K and the transfer surface of the intermediate transfer belt 606 by the steering operation of the steering roller 605. As shown in FIG. 2, the intermediate transfer belt unit 200 also includes the edge detection sensor 1 that detects a variation in the position of the intermediate transfer belt 606 in the direction (second direction or Y-axis direction (the direction of the rotating shaft of the driving roller)) perpendicular to the direction (first direction or X-axis direction) in which the belt should move. The edge detection sensor 1 is, for example, a belt position detection sensor that detects the position of the end of the intermediate transfer belt 606 in the Y-axis direction by detecting, by a sensor, the tilt amount of an arm-shaped contactor that comes into contact with the end of the intermediate transfer belt 606.

Figure 4:
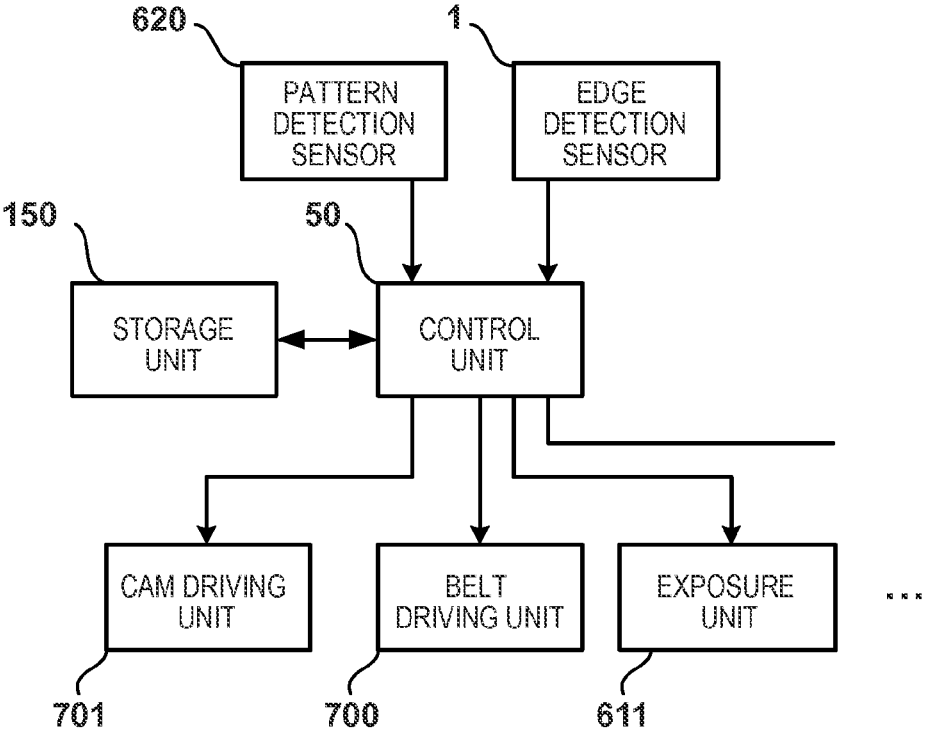
FIG. 4 is a block diagram of the image forming apparatus according to an embodiment.
Figure 5:
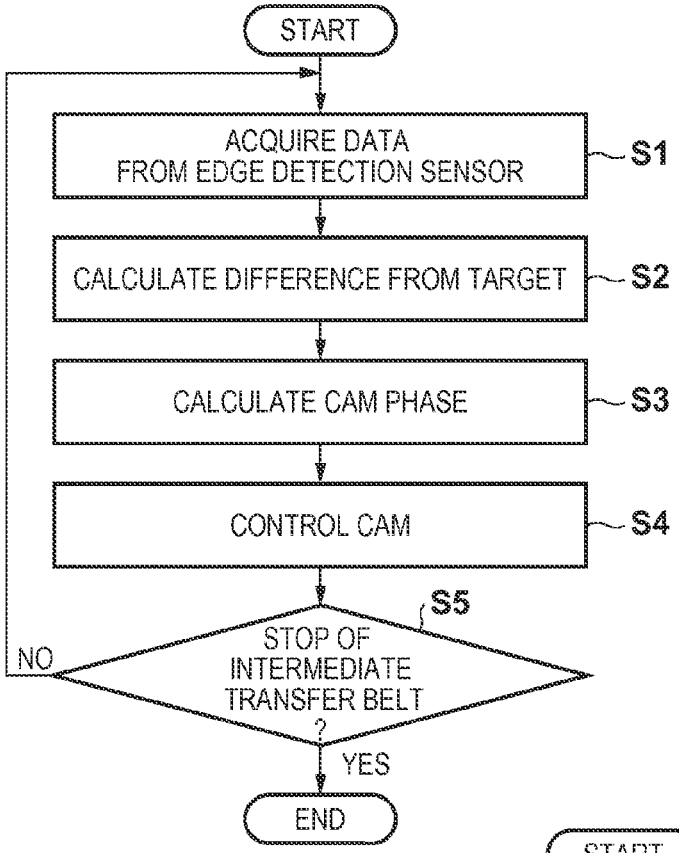
FIG. 5 is a flowchart of steering control according to an embodiment.

FIG. 4 is a block diagram of the image forming apparatus. FIG. 5 is a flowchart of steering control executed by a control unit 50 shown in FIG. 4 to modify the variation (shift) in the Y-axis direction position of the intermediate transfer belt 606, that is, suppress the variation in the direction perpendicular to the direction in which the belt should move. Note that in FIG. 4, a belt driving unit 700 is, for example, a motor configured to rotate the driving roller 604 of the intermediate transfer belt unit 200. The control unit 50 executes steering control shown in FIG. 5 during the time in which the belt driving unit 700 is rotating the intermediate transfer belt 606 in the direction indicated by the arrow in FIG. 1. When steering control starts, in step S1, the control unit 50 acquires position data of the end of the intermediate transfer belt 606 from the edge detection sensor 1. In step S2, the control unit 50 calculates the difference between the target position of the end of the intermediate transfer belt 606 and the current position of the end of the intermediate transfer belt 606 based on the position data of the end of the intermediate transfer belt 606 and the target position data of the end of the intermediate transfer belt 606 held in a storage unit 150 and corresponding to the target position of the belt end. In step S3, the control unit 50 calculates the rotation phase of the steering cam 5 to move the position of the end of the intermediate transfer belt 606 to the target position by, for example, PID control. In step S4, the control unit 50 controls the cam driving unit 701 such that the steering cam 5 obtains the rotation phase obtained in step S3. In step S5, the control unit 50 determines the driving state of the intermediate transfer belt 606, and repeats the processes in steps S1 to S4 during driving of the intermediate transfer belt 606. The shift of the intermediate transfer belt 606 is thus prevented by steering control during driving of the intermediate transfer belt 606.

Figure 6:
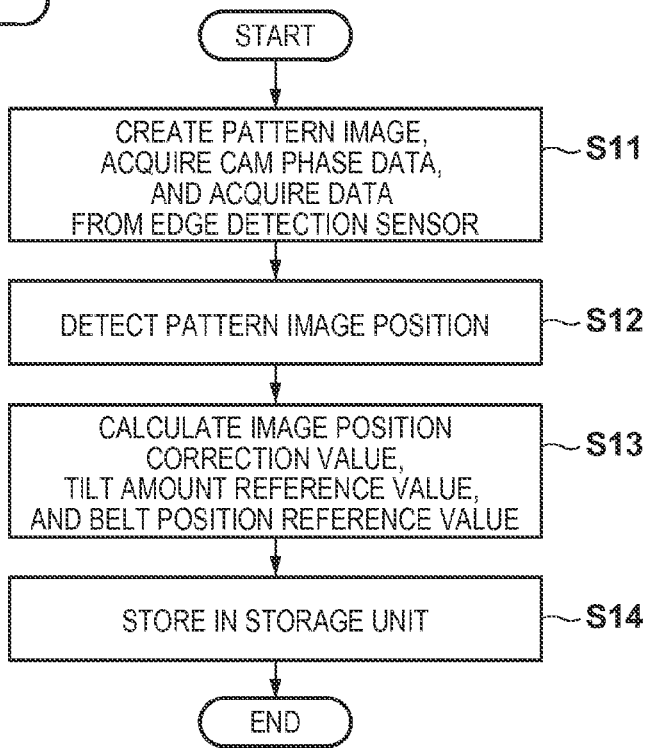
FIG. 6 is a flowchart of image position correction control according to an embodiment.

Correction value acquisition control executed by the control unit 50 will be described next with reference to FIG. 6. Note that the control unit 50 executes the correction value acquisition control when a condition stored in the storage unit 150 in advance is satisfied, for example, when the image forming apparatus has been powered on or the number of printed sheets has reached a predetermined number. The correction value acquisition control may be executed in accordance with a start instruction from the user. Note that the steering control shown in FIG. 5 is executed even during the correction value acquisition control.

Figure 7:
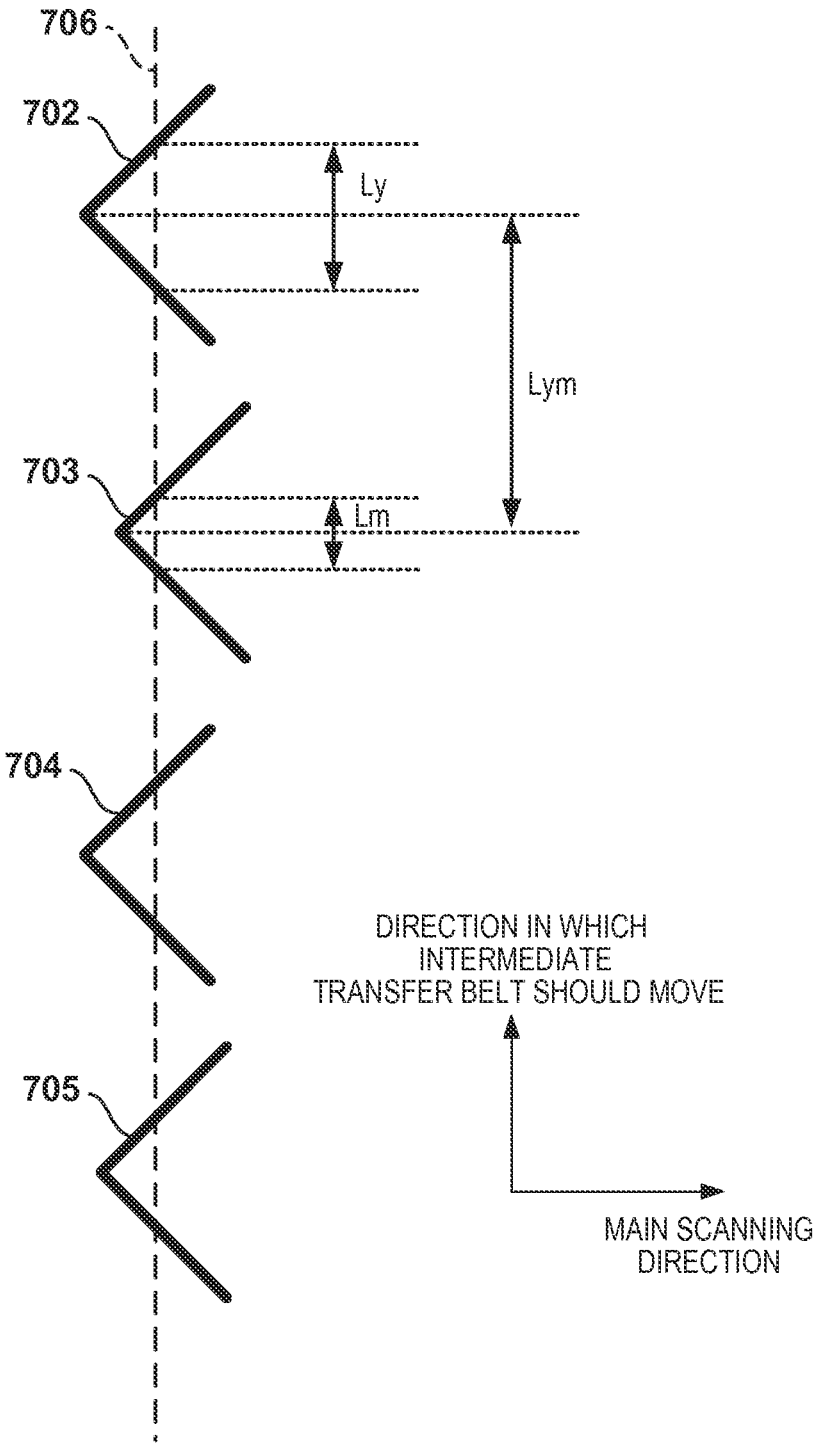
FIG. 7 is a view showing pattern images formed by the image position correction control according to an embodiment.

When correction value acquisition control starts, in step S11, the control unit 50 controls the image forming units 6 to form, on the intermediate transfer belt 606, pattern images used to detect the image forming positions of the respective colors. More specifically, a plurality of sets of pattern images 702, 703, 704, and 705 of the respective colors shown in FIG. 7 are formed on the intermediate transfer belt 606. Note that the pattern images 702, 703, 704, and 705 are toner images of yellow, magenta, cyan, and black, respectively. At this time, the control unit 50 acquires the rotation phase of the steering cam 5 when the pattern images are generated, and acquires, from the edge detection sensor 1, the position of the belt end when the pattern images are generated. Note that since the pattern images are formed over a certain time, the rotation phase of the steering cam 5 and the position of the end of the intermediate transfer belt 606 within the certain time in which the pattern images are formed may be acquired. Alternatively, a representative rotation phase of the steering cam 5 and a representative position of the end of the intermediate transfer belt 606 within the certain time may be acquired. In this embodiment, the rotation phase of the steering cam 5 and the position of the end of the intermediate transfer belt 606 within the certain time in which the pattern images are formed are acquired.

The time from the pattern image formation to the pattern image detection by the pattern detection sensor 620 is very short. For this reason, the rotation phase of the steering cam 5 when the pattern images are generated almost equals the rotation phase of the steering cam 5 when the pattern detection sensor 620 detects the pattern images. In addition, the position of the end of the intermediate transfer belt 606 when the pattern images are generated almost equals the position of the end of the intermediate transfer belt 606 when the pattern detection sensor 620 detects the pattern images. Hence, the rotation phase of the steering cam 5 and the position of the end of the intermediate transfer belt 606 within the period in which the pattern detection sensor 620 detects the pattern images may be acquired.

In step S12, the control unit 50 detects the relative positional relationship between the pattern images of the respective colors using the pattern detection sensor 620 for the pattern images of each set. More specifically, the relative positional shift between the pattern images of the respective colors in the main scanning direction can be detected by measuring the distance between two points of each pattern image on a line 706 in FIG. 7. FIG. 7 illustrates a distance Ly between two points where the pattern image 702 crosses the line 706, and a distance Lm between two points where the pattern image 703 crosses the line 706. As is apparent from FIG. 7, the shorter the distance between the two points is, the larger the rightward shift of the pattern image in the main scanning direction shown in FIG. 7 is. That is, the relative positional shift with respect to a reference pattern image can be detected by comparing the measured distance between the two points with the distance between the two points of the reference pattern image. In addition, the center position of each pattern image can be determined from the center of the distance between the two points. The relative positional shift of each pattern image in the sub-scanning direction can be determined from the distance between the center positions of the pattern images. Note that the sub-scanning direction is the direction in which the intermediate transfer belt 606 should move.

In step S13, the control unit 50 calculates, for each color, the average value of the relative positional shifts with respect to the reference pattern image measured in the sets of pattern images, and obtains the average value as the image position correction value of the toner image of the corresponding color. Additionally, in step S13, the control unit 50 calculates the average value of the rotation phases of the steering cam 5 when the pattern images of each color are generated, which are acquired in step S11, and obtains the average value as the tilt amount reference value of the steering roller 605. Furthermore, in step S13, the control unit 50 calculates the average value of the positions of the end of the intermediate transfer belt 606 when the pattern images of each color are generated, which are acquired in step S11, and obtains the average value as the position reference value (reference position) of the intermediate transfer belt 606. In step S14, the control unit 50 stores, in the storage unit 150, the image position correction value, the tilt amount reference value, and the position reference value of each color obtained in step S13.

Figure 8:
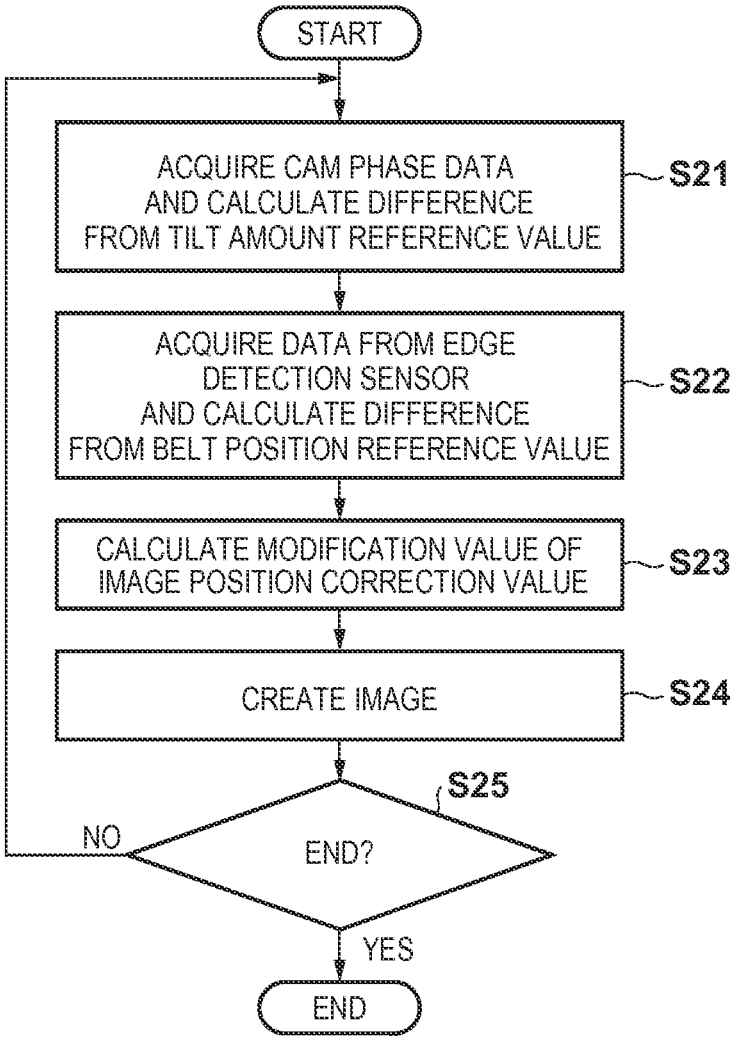
FIG. 8 is a flowchart of image formation control according to an embodiment.

Image formation control will be described next with reference to FIG. 8. Note that the steering control shown in FIG. 5 is executed even during the image formation control shown in FIG. 8. In step S21, the control unit 50 acquires the rotation phase value (rotation phase state) of the steering cam 5, and calculates the difference from the tilt amount reference value held in the storage unit 150. In step S22, the control unit 50 acquires the position data of the intermediate transfer belt 606 in the Y direction (main scanning direction) in FIG. 2 from the edge detection sensor 1, and calculates the difference from the position reference value held in the storage unit 150.

In step S23, based on the difference from the tilt amount reference value and the difference from the position reference value, the control unit 50 calculates a modification value of the image position correction value stored in the storage unit 150, regarding the position in the main scanning direction. More specifically, the control unit 50 calculates the modification value for the image write position in the main scanning direction. Note that the relationship between the modification value of the image position correction value and the difference from the tilt amount reference value and the difference from the belt position reference value is decided in advance as shown in FIG. 9 by, for example, pre-measurement and stored in the storage unit 150. Instead of creating a table as shown in FIG. 9 in advance and storing it in the storage unit 150, a determinant or the like representing the relationship between the modification value of the image position correction value and the difference from the tilt amount reference value and the difference from the position reference value may be decided in advance and stored in the storage unit 150. In step S24, the control unit 50 controls the image formation position based on the image position correction value modified by the modification value calculated in step S23, thereby forming an image of one page. More specifically, the write positions in the main scanning direction when the exposure devices 611Y, 611M, 611C, and 611K of the image forming units 6Y, 6M, 6C, and 6K expose the corresponding photosensitive members 608Y, 608M, 608C, and 608K, respectively, are modified by the calculated modification values. In step S25, the control unit 50 determines whether the image formation has ended for all pages, and repeats the processes in steps S21 to S24 until the image formation ends for all pages.

With the above-described arrangement, color misalignment in the main scanning direction caused by steering control can be corrected while suppressing the belt shift by steering control.

(Second Embodiment)

Figure 10:
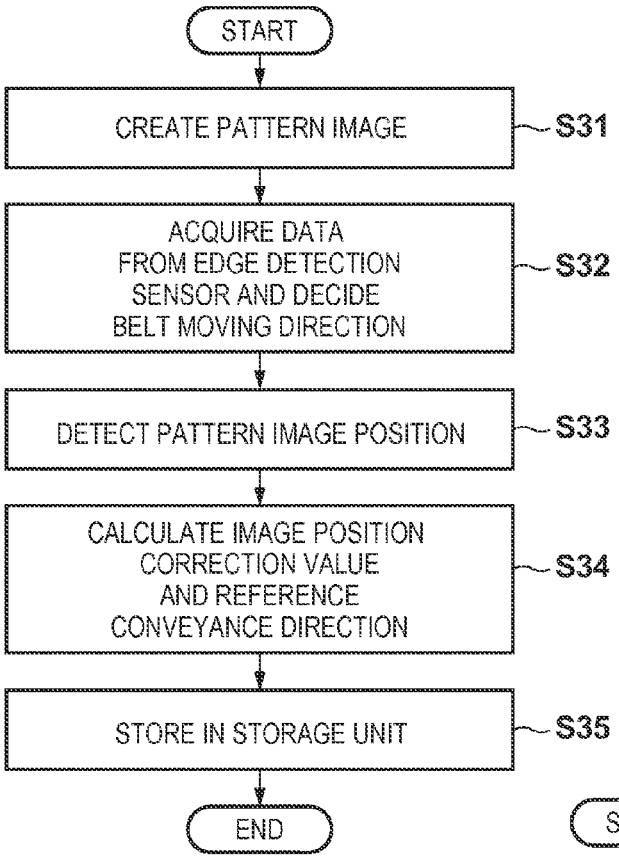
FIG. 10 is a flowchart of image position correction control according to an embodiment.

For the second embodiment, the difference from the first embodiment will mainly be described. Image position correction control executed by a control unit 50 in this embodiment will be described first with reference to FIG. 10. Note that the execution condition of the image position correction control is the same as in the first embodiment. In this embodiment as well, the control unit 50 executes the steering control explained with reference to FIG. 5 during the image position correction control.

When the image position correction control starts, in step S31, the control unit 50 creates a set of pattern images 702, 703, 704, and 705 shown in FIG. 7 on the intermediate transfer belt 606 a plurality of times. In step S32, the control unit 50 calculates, from belt position data acquired by an edge detection sensor 1, the actual moving direction (third direction) of an intermediate transfer belt 606 when each pattern image is transferred to the intermediate transfer belt 606. More specifically, the actual moving direction of the intermediate transfer belt 606 when the pattern image of each color is transferred to the intermediate transfer belt 606 is obtained from the moving velocity in the sub-scanning direction by a driving roller 604 and the position variation in the main scanning direction obtained based on the data detected by the edge detection sensor 1.

In step S33, the control unit 50 detects the relative positional relationship between the pattern images of the respective colors using a pattern detection sensor 620 for the pattern images of each set, as in the first embodiment. After that, in step S34, the control unit 50 calculates, for each color, the average value of the relative positional shifts with respect to a reference pattern image measured in the sets of pattern images, and obtains the average value as the image position correction value of the toner image of the corresponding color. Additionally, in step S34, the control unit 50 calculates the average value of the actual moving directions acquired in step S32 for each color, and obtains the average value as the reference moving direction for each color. In step S35, the control unit 50 stores, in a storage unit 150, the image position correction value and the value representing the reference moving direction obtained in step S34.

Figure 11:
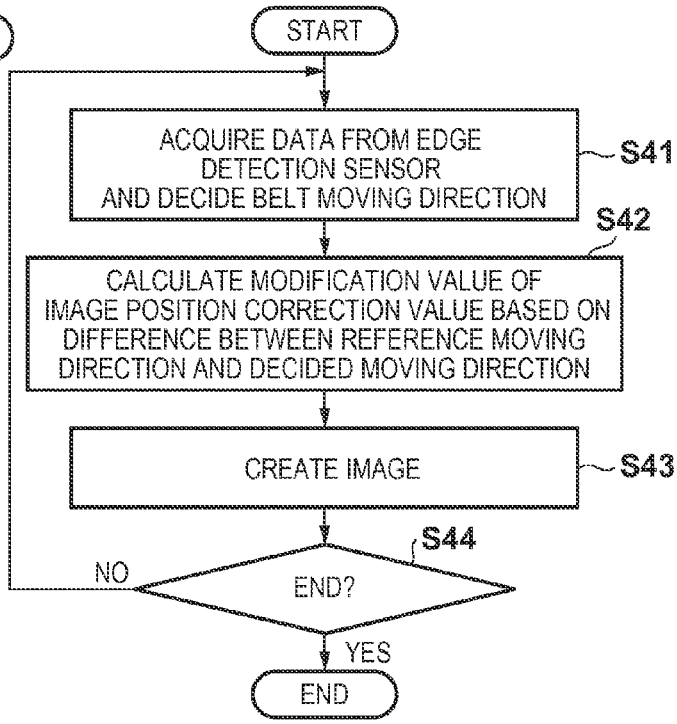
FIG. 11 is a flowchart of image formation control according to an embodiment.

Image formation control will be described next with reference to FIG. 11. Note that the steering control shown in FIG. 5 is executed even during the image formation control shown in FIG. 11. In step S41, the control unit 50 acquires the position data of the belt end from the edge detection sensor 1, and monitors the actual moving direction of the intermediate transfer belt 606.

In step S42, based on the difference between the value representing the reference moving direction and a value representing the monitored actual moving direction for each color, the control unit 50 calculates a modification value of the image position correction value of each color stored in the storage unit 150, regarding the main scanning direction. Note that the relationship between the difference from the value representing the reference moving direction and the modification value of the image position correction value is decided in advance by pre-measurement and stored in the storage unit 150, as in the first embodiment. The value representing the direction is, for example, a value representing, by an angle, the shift from the direction in which the intermediate transfer belt 606 should move. Since the moving velocity in the direction in which the belt should move is constant, the value representing the direction may be a position variation amount per unit time in the direction perpendicular to the direction in which the belt should move. In step S43, the control unit 50 forms an image of one page based on the image position correction value modified by the modification value calculated in step S42. In step S44, the control unit 50 determines whether the image formation has ended for all pages, and repeats the processes in steps S41 to S43 until the image formation ends for all pages.

With the above-described arrangement, color misalignment in the main scanning direction caused by steering control can be corrected while suppressing the belt shift by steering control.

Figure 12:
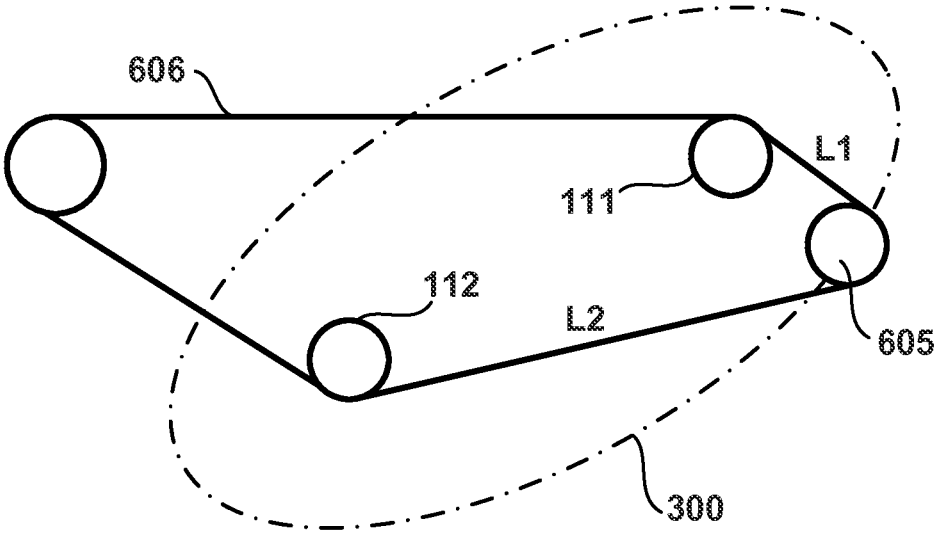
FIG. 12 is an explanatory view of the constraint condition of the intermediate transfer belt for a steering roller.

For a more specific understanding of the present invention, a change in the belt moving direction and color misalignment in the main scanning direction caused by tilting a steering roller 605 will be described below. FIG. 12 illustrates the general loop layout of the intermediate transfer belt 606 that is an endless belt. Referring to FIG. 12, the intermediate transfer belt 606 loops over four rollers. The positions of three rollers except the steering roller 605 are fixed. The intermediate transfer belt 606 is made of a material of a high Young's modulus, and its expansion and contraction can almost be neglected. At this time, the movable range of the steering roller 605 is limited to the range where the condition that the value of L1+L2 in FIG. 12 is constant is satisfied. Note that L1 is the distance between the contact points of the intermediate transfer belt 606 with respect to a roller 111 and the steering roller 605, and L2 is the distance between the contact points of the intermediate transfer belt 606 with respect to a roller 112 and the steering roller 605. That is, the movable range of the steering roller 605 is limited to an elliptical orbit 300 having the rollers 111 and 112 as the focal points. This is because the belt having the high Young's modulus poses the constraint condition that the belt length is constant.

Figure 13:
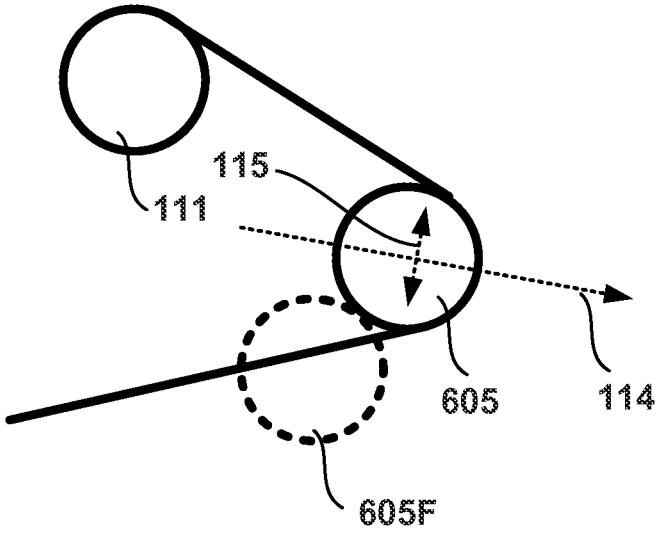
FIG. 13 is an explanatory view of tilt of the steering roller.

As shown in FIG. 13, the steering roller 605 is biased by a spring or the like in the direction indicated by an arrow 114. The steering tilting mechanism changes an end 605F of the steering roller 605 in the direction of an arrow 115. However, because of the constraint condition that the belt length is constant and the bias by a spring or the like, as described above, the end 605F shifts from the direction of the arrow 115 and is corrected to the position indicated by the dotted line. A change in the shaft alignment, that is, loss of parallelism to the other rollers caused by the correction, becomes the change in the belt moving direction.

Figure 14:
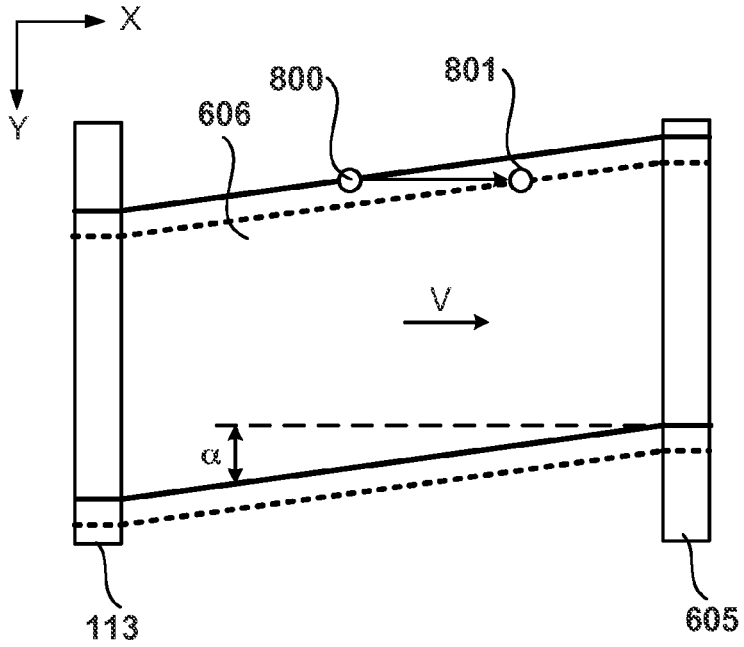
FIG. 14 is an explanatory view of color misalignment in the main scanning direction caused by steering control.

FIG. 14 shows a state in which the intermediate transfer belt 606 is driven to travel in the direction of an arrow V. Note that the solid line indicates a state at a time t, the dotted line indicates a state at a time t+Δt, and the intermediate transfer belt 606 moves in the X direction in a loop orientation having a tilt α. At this time, the end of the intermediate transfer belt 606 changes its position between the time t and the time t+Δt, and moves in the Y direction. That is, a belt shift occurs. However, a position 800 at the time t becomes a position 801 moved straight in the X direction at the time t+Δt, and no displacement in the Y direction occurs. In this case, no color misalignment in the main scanning direction occurs.

Figure 15:
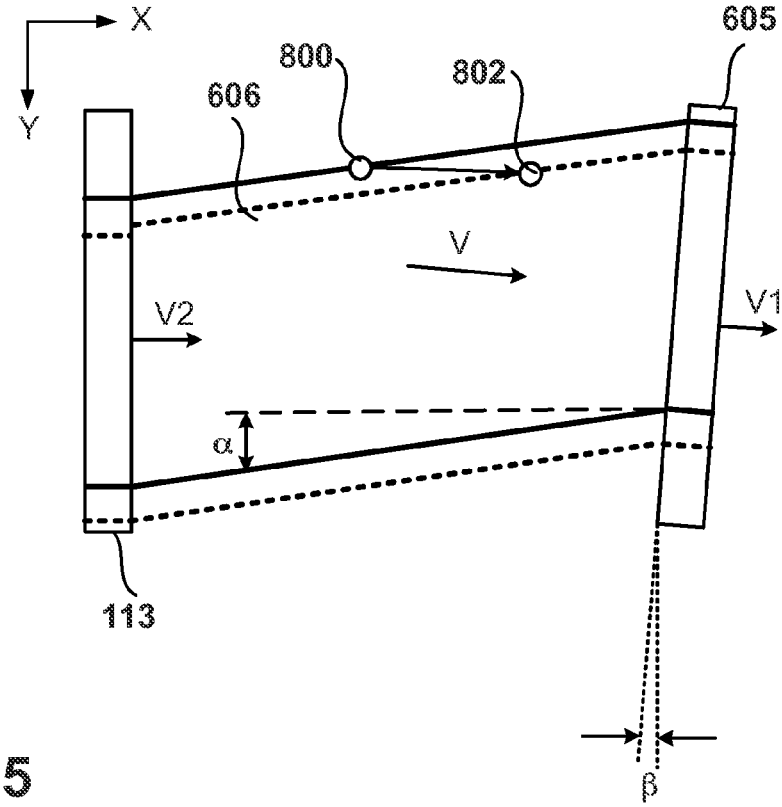
FIG. 15 is an explanatory view of color misalignment in the main scanning direction caused by steering control.

When the steering tilting mechanism tilts the steering roller 605, a distortion occurs as explained with reference to FIG. 13, the parallelism to the other rollers is lost, and a loop orientation having the tilt α and a tilt β in the moving direction are generated, as shown in FIG. 15. As a result, the position 800 at the time t becomes a position 802 not only moved straight in the X direction but also changed in the Y direction as well at the time t+Δt. This is the cause of color misalignment in the main scanning direction by the steering control. As shown in FIG. 15, let V2 be the moving direction by a roller 113, and V1 be the moving direction by the steering roller 605. In this case, the moving direction of the belt loop surface between the roller 113 and the steering roller 605 is dominated by the moving direction V1 by the steering roller 605 on the downstream side. The reason for this will be described below.

Figure 16:
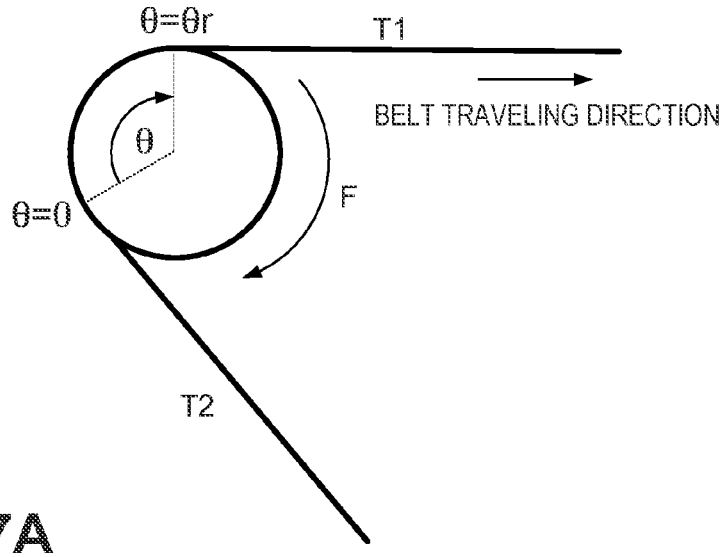
FIG. 16 is a view showing the relationship between the tension of the belt and a driving force or a load power.

The force of constraint for the belt by the rollers to loop the belt is described by Euler's relational expression, to be described below. As shown in FIG. 16, let T1 be the tension of the belt on the side where the belt is fed from a roller, T2 be the tension on the side where the belt enters the roller, and F be the force generated on the outer surface by the driving force or load power of the roller. When the belt and the roller rotate integrally, $$T1+F=T2 \quad \ldots (1)$$

holds due to the equilibrium of the forces. Note that when F is positive, it represents the driving force of the roller, and when F is negative, it represents the load power of the roller. Let θ be the angle from the start of winding of the belt around the roller, and μA be the coefficient of static friction between the belt and the roller. Based on the known Euler's equation, a tension T' of the belt at the position of the angle θ is given by $$T'=T1\times e^{\mu\theta}\text{(when F is positive)} \quad \ldots (2)$$

$$T'=T1\times e^{-\mu\theta}\text{(when F is negative)} \quad \ldots (3)$$

Letting θr be the angle of the belt wound around the roller, conditions that allow the belt and the roller to integrally rotate without slip are given by $$T1\times e^{\mu\theta r}>T2\text{(when F is positive)} \quad \ldots (4)$$

$$T1\times e^{-\mu\theta r}<T2\text{(when F is negative)} \quad \ldots (5)$$

Figure 17A:
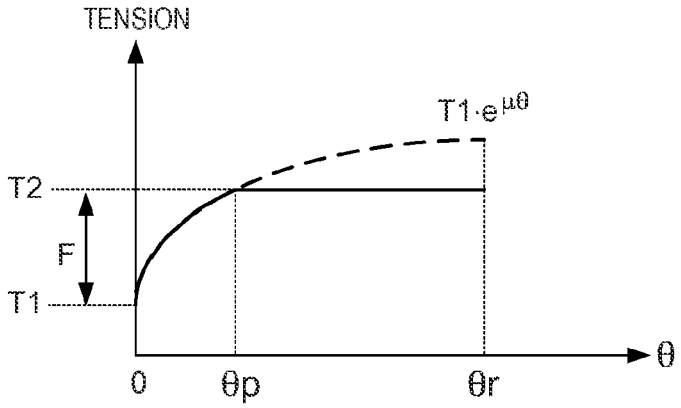
FIGS. 17A and 17B are graphs showing tension distributions when the belt and the roller do not slip.
Figure 17B:
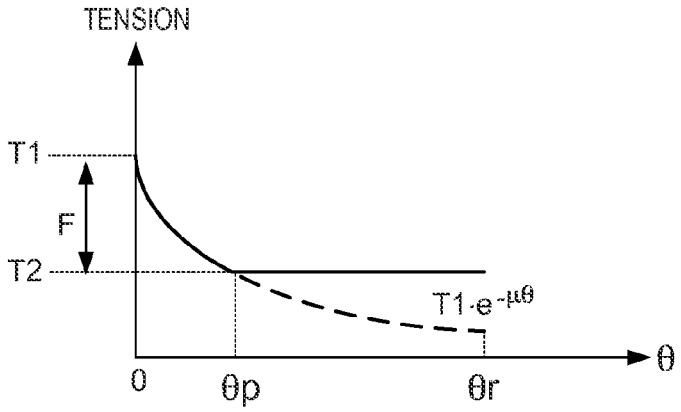

FIGS. 17A and 17B show tension distributions when inequalities (4) and (5) are satisfied. Note that FIG. 17A shows the tension distribution when F is positive, and FIG. 17B shows the tension distribution when F is negative. Referring to FIGS. 17A and 17B, let θp be the angle at which the tension of the belt wound around the roller equals T2. Within the angle range from 0 to θp, the tension changes in accordance with the Euler's equation. However, within the angle range from θp to θr, the tension is constant at T2.

Figure 18A:
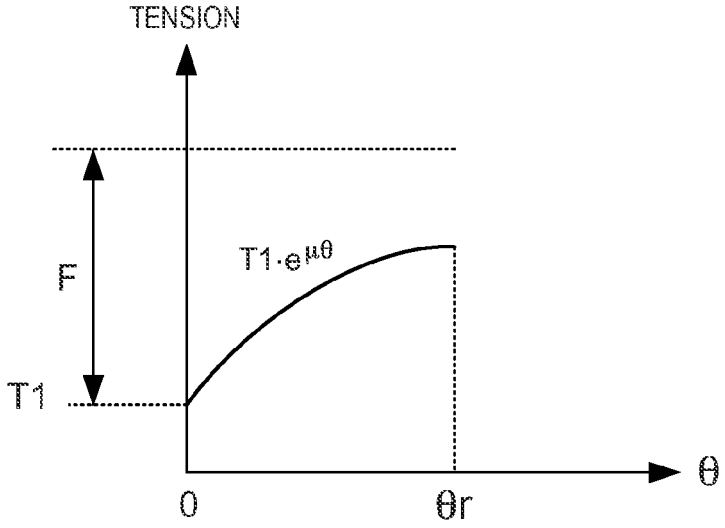
FIGS. 18A and 18B are graphs showing tension distributions when the belt and the roller slip.
Figure 18B:
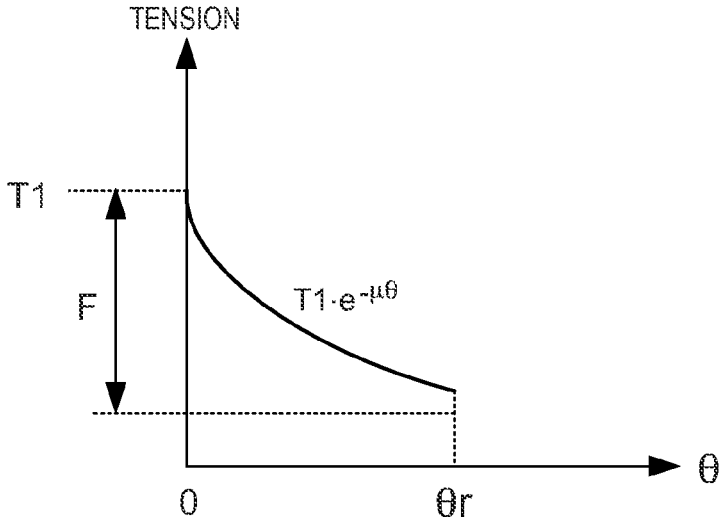

On the other hand, FIGS. 18A and 18B show tension distributions when inequalities (4) and (5) cannot be satisfied because the coefficient μ of static friction is small, or the angle θr of the belt wound around the roller is small. Note that FIG. 18A shows the tension distribution when F is positive, and FIG. 18B shows the tension distribution when F is negative. In this case, the change in the tension does not reach the value in balance with the driving force or load power within the winding range of the belt around the roller. Hence, the belt slips on the roller.

In the tension distributions shown in FIGS. 17A and 17B, the tension changes within the range of θ=0 to θp. This is a state in which the driving force or load power is transmitted to each other due to the maximum static frictional force between the roller and the belt. Hence, if a force is applied to the belt on the downstream side of the roller by disturbance, a slip readily occurs in this region. Note that when the disturbance is eliminated, the state returns to the state without slip again. On the other hand, even when a force is applied to the belt on the upstream side of the roller by disturbance, no slip occurs between the roller and the belt. This is because the region of θ=θp to θr does not contribute to driving force or load power transmission between the belt and the roller, and a margin remains with respect to the maximum static frictional force.

As shown in FIG. 15, when a difference is generated between the moving direction V2 by the roller 113 and the moving direction V1 by the steering roller 605, a force is applied to the belt winding portion of each roller because the belt having the high Young's modulus hardly deforms. For the steering roller 605, the force becomes disturbance on the upstream side. Hence, the steering roller 605 is hardly affected by the disturbance and can maintain the moving direction V1. For the roller 113, however, the force becomes disturbance on the downstream side. For this reason, a slip occurs between the belt and the roller, and the moving direction V2 cannot be maintained. The intermediate transfer belt 606 follows the moving direction by the steering roller 605. This is the reason why the moving direction by the roller on the downstream side of the moving direction is dominant in the moving direction of the belt loop surface.

In the above-described way, the displacement of the intermediate transfer belt 606 in the Y direction, that is, the color misalignment amount is decided by the tilt amount of the steering roller 605. Note that in this embodiment, the steering roller 605 is tilted by making the steering cam 5 pivot. The tilt amount of the steering cam 5 and that of the steering roller 605 have a 1:1 relationship. How much color misalignment occurs due to the tilt of the steering roller 605 depends on the positional relationship between the intermediate transfer belt 606 and the steering roller 605. This is because as already described above, when the steering roller 605 tilts, the parallelism to the other rollers is lost due to the constraint condition of the belt, and the degree of loss depends on the position of the intermediate transfer belt 606. That is, for example, the degree of loss of the parallelism of the roller 605 to the other rollers changes between a case in which the intermediate transfer belt 606 shifts to the side of the end 605F and a case in which the intermediate transfer belt 606 shifts to the side of an end 605R even if a steering arm 8*a* is moved in the same amount.

Hence, in the above-described embodiment, it is possible to perform control more accurately in steering control and image formation control by considering the position of the intermediate transfer belt 606 in the main scanning direction.

(Third Embodiment)

For this embodiment, the difference from the second embodiment will mainly be described below. In step S41 of FIG. 11, the control unit 50 acquires the data of the belt position from the edge detection sensor 1, and monitors the actual moving direction of the intermediate transfer belt 606. However, at the start of driving of an intermediate transfer belt 606 or at a timing when a secondary transfer unit 66 comes into contact with the intermediate transfer belt 606 or separates from the intermediate transfer belt 606, a variation in the moving direction occurs independently of steering control.

For example, if the intermediate transfer belt 606 maintains the orientation at the end of preceding driving, driving of the intermediate transfer belt 606 starts in a state as shown in FIG. 15. In this case, the belt moving direction varies due to the tilt of a steering roller 605. In addition, for example, consider a state in which the axes of the secondary transfer unit 66 and a secondary transfer roller 66*b* shown in FIG. 1 shift from each other. In this case, in a state in which the secondary transfer unit 66 is in contact with the intermediate transfer belt 606, the moving direction may change as compared to a state in which they are not in contact due to the same reason as described with reference to FIG. 16. The change in the moving direction that occurs independently of steering control will be referred to as a moving direction variation by non-steering control hereinafter.

In this embodiment, the relationship between the elapsed time and the moving direction caused by non-steering control is obtained as a time function in advance. In non-steering control that affects the moving direction, when determining the actual moving direction in step S41 of FIG. 11, the variation in the moving direction caused by non-steering control is taken into consideration in addition to the variation in the moving direction caused by steering control, as in the second embodiment. More specifically, a moving direction obtained based on belt position data from an edge detection sensor 1 is modified by a moving direction obtained by the time function. The subsequent processing is the same as in the second embodiment.

Time function setting control will be described below. First, a pattern detection sensor 620 reads each pattern image created upon non-steering control. A storage unit 150 stores the time at which each pattern image has been read. Steering control need not be performed during time function setting control, but may be performed. When steering control is performed, the time function is identified by subtracting the amount of the variation in the moving direction caused by steering control. When steering control is not performed, the time function is directly identified by the relative positions of the detected pattern images of the respective colors.

Figure 19:
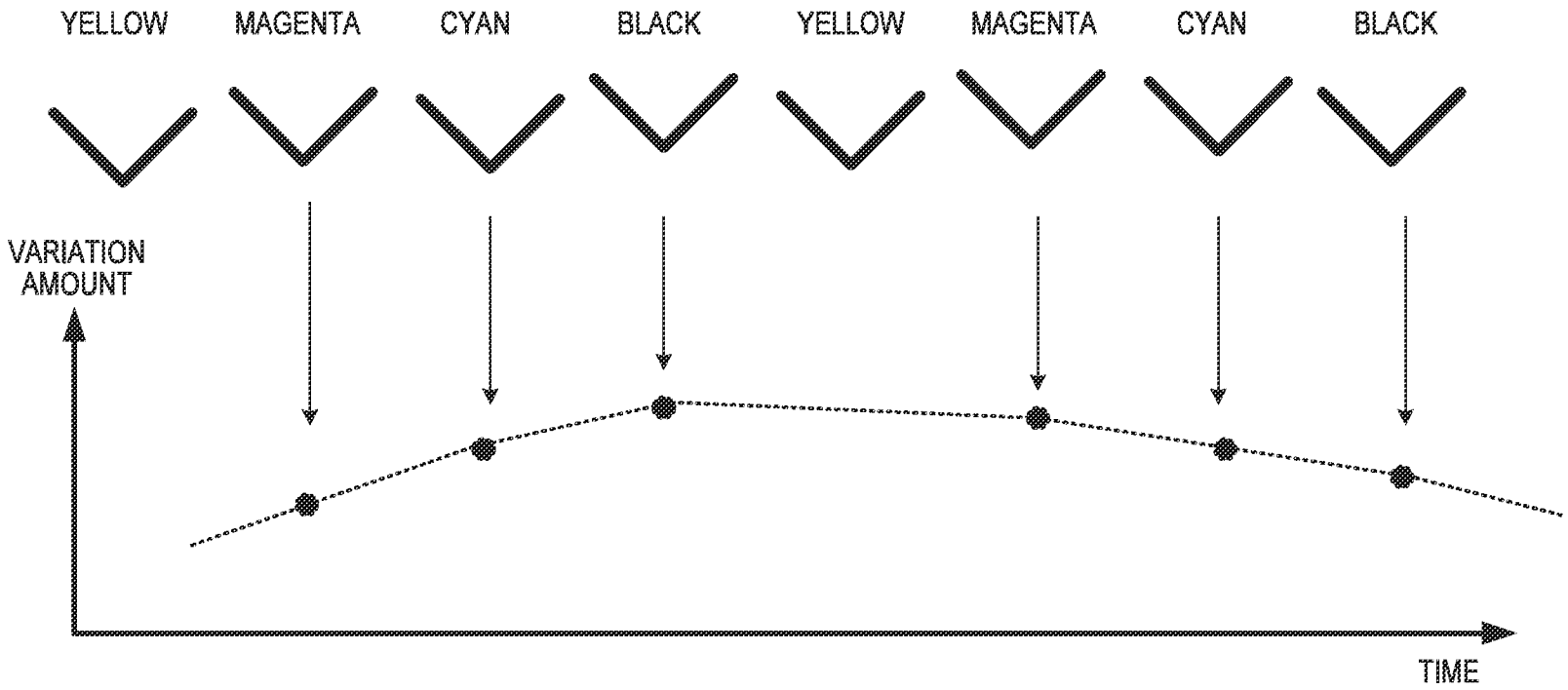
FIG. 19 is an explanatory view of time function identification in the moving direction.

The time function represents the moving direction as a function of time from the amount of a variation in the position of a pattern image relative to a reference image. FIG. 19 illustrates how to identify a time function with respect to yellow. Note that the reference color can be any color. The time function used to calculate the moving direction independent of steering control is calculated as shown in FIG. 19. Note that the time function setting control can be performed either simultaneously with or independently of image position correction control.

Figures 20A, 20B:
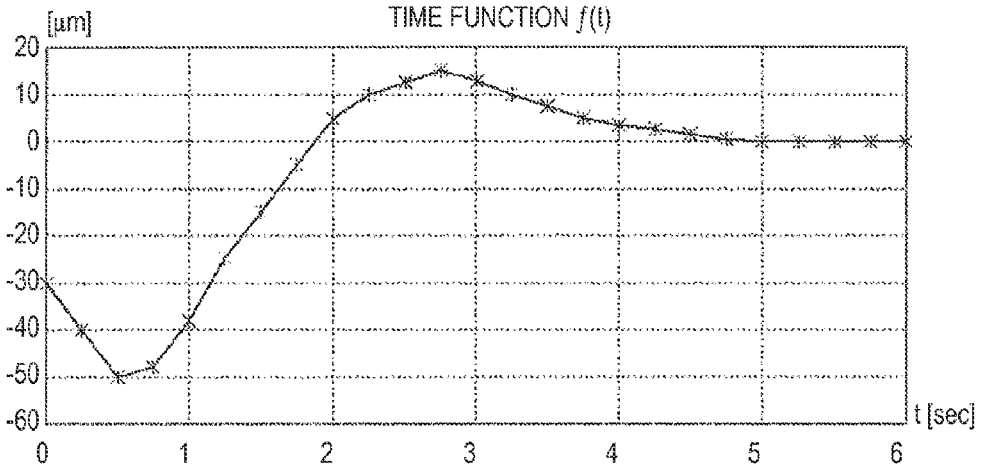
FIG. 20A is a table showing the relationship between the time and the moving direction.
FIG. 20B is a graph showing the relationship between the time and the moving direction.

Note that for the time function, a table representing the relationship between the time and the moving direction may be generated and stored in the storage unit 150, as shown in FIG. 20A. Alternatively, as indicated by the curve shown in FIG. 20B, the time function may be stored in the storage unit 150 in a form of a function for calculating the moving direction by a time, as will be described below. Note that the moving direction is represented by, for example, an angle with reference to the direction in which the intermediate transfer belt 606 should move. In addition, since the driving speed in the direction in which the intermediate transfer belt 606 should move is constant, the variation amount per unit time in the main scanning direction may be used as the time function.

$$f(t)=a_0+a_1t+a_2t^2+a_3t^3+\ldots \quad \text{(a)}$$

$$f(t)=a_0+e^{-1}(a_1t+a_2t^2+a_3t^3+\ldots) \quad \text{(b)}$$

As described above, the change in the belt moving direction corresponding to color misalignment in the main scanning direction can be calculated from the tilt amount of the steering roller 605 by steering control, the belt position detected by the edge detection sensor 1, and the time function. The tilt amount of the steering roller 605 in steering control is decided by detecting the difference between the target position and the output of the edge detection sensor 1 a plurality of times. The belt position is also represented by the difference from the target position. That is, the variation in the moving direction caused by steering control can be calculated by the output history of the edge detection sensor 1. This can be represented by $$Y(t)=\lambda_1y(t-\Delta t)+\lambda_2(t-2\Delta t)+\ldots+\lambda_py(t-p\Delta t)+\epsilon_0\mu(t)+\epsilon_1\mu(t-\Delta t)+\ldots++\epsilon_q\mu(t-q\Delta t)$$

where μ is the output of the edge detection sensor 1, and y is the belt moving direction. The belt moving direction y(t) is formulated by the past history of y(t) and the current value and past history of μ(t). This is equivalent to the following transfer function state space expression.

$$\begin{pmatrix} x_1(t+\Delta t) \\ x_2(t+\Delta t) \\ \vdots \\ x_s(t+\Delta t) \end{pmatrix} = \begin{bmatrix} \alpha_{11} & \alpha_{12} & \cdots & \alpha_{1s} \\ \alpha_{21} & \alpha_{22} & & \alpha_{2s} \\ \vdots & & \ddots & \vdots \\ \alpha_{s1} & \alpha_{s2} & \cdots & \alpha_{ss} \end{bmatrix} \begin{pmatrix} x_1(t) \\ x_2(t) \\ \vdots \\ x_s(t) \end{pmatrix} + \begin{pmatrix} \beta_1 \\ \beta_2 \\ \vdots \\ \beta_s \end{pmatrix} \mu(t)$$

$$y(t) = \lfloor \gamma_1 \quad \gamma_2 \quad \cdots \quad \gamma_s \rfloor \begin{pmatrix} x_1(t) \\ x_2(t) \\ \vdots \\ x_s(t) \end{pmatrix}$$

When the necessary degrees (p, q, s) and coefficients of the above equations are identified in advance, the belt moving direction can be calculated from the output history of the edge detection sensor 1.

Figure 21:
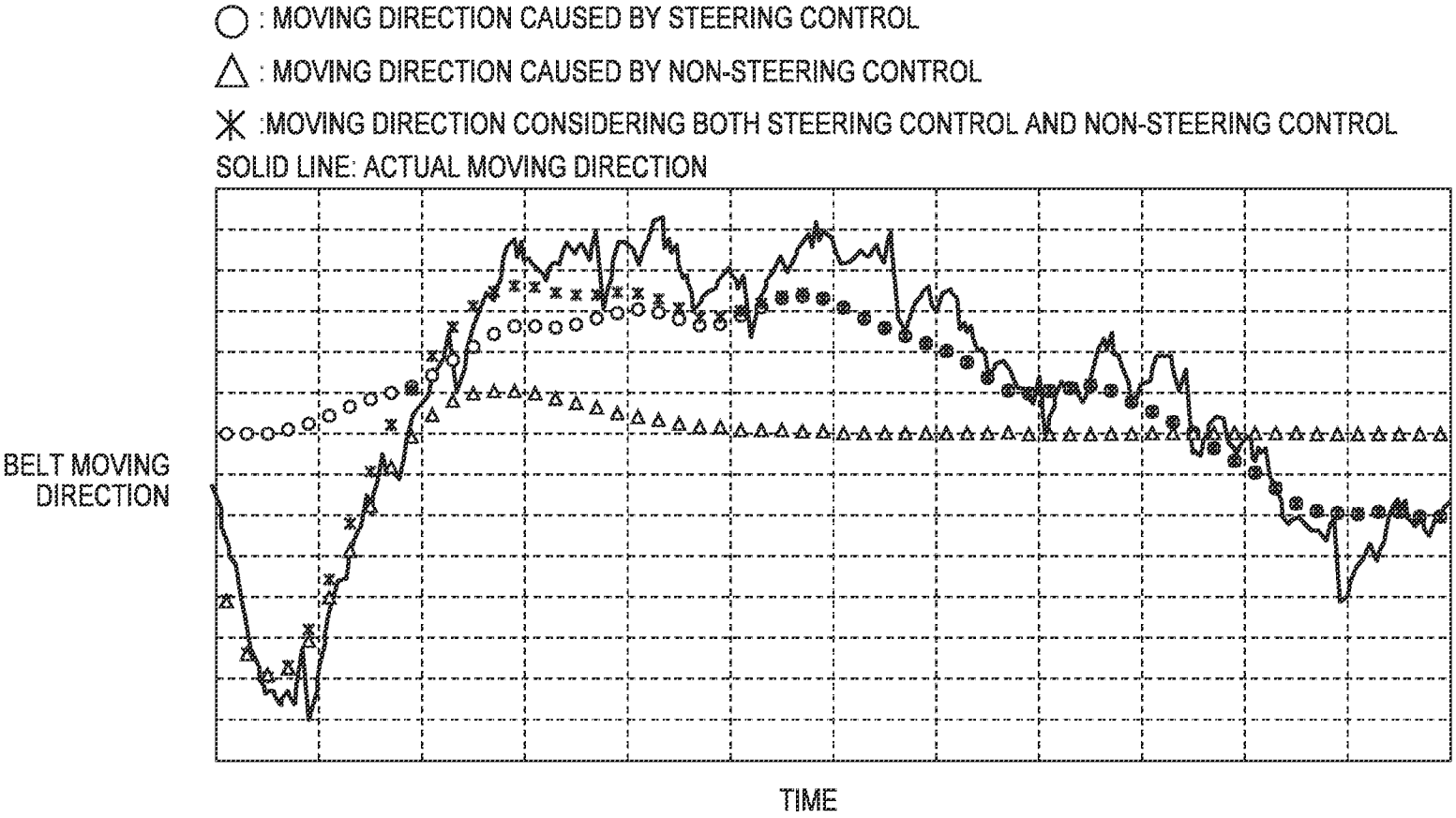
FIG. 21 is a graph showing time-rate changes in an actual moving direction and a moving direction calculated by a control unit.

FIG. 21 shows a moving direction caused by steering control obtained by a control unit 50 from detection data of the edge detection sensor 1, a moving direction caused by non-steering control obtained by a time function, and a moving direction obtained in consideration of both moving directions. FIG. 21 also shows an actual moving direction for the sake of comparison. As shown in FIG. 21, when the moving direction caused by non-steering control is also taken into consideration, the actual moving direction can accurately be obtained. More specifically, the control unit 50 holds a value representing the relationship between the time and the transfer belt moving direction caused by non-steering control, and uses the relationship between the time and the moving direction as well to calculate the actual moving direction. Non-steering control is control other than the control shown in FIG. 5. Examples are an operation of tilting the steering roller 605 by control other than steering control or control such as the state of the secondary transfer unit 66 that affects the moving direction of the intermediate transfer belt 606, as described above.

Note that when the influence of the belt moving direction by steering control is small, or in a rib regulating method of regulating a belt shift not by steering control but by bonding a rib member to the end of the intermediate transfer belt 606, only the variation in the moving direction by non-steering control is taken into consideration. In this case, in step S41 of FIG. 11, the moving direction by non-steering control is determined using a time function obtained in advance. In step S43, an image is created based on the moving direction obtained in step S41.

As described above, to suppress the variation in the position of the intermediate transfer belt 606, the control unit 50 determines the actual moving direction of the intermediate transfer belt 606, and controls the write position on each photosensitive member 608 by the exposure unit 611 while controlling the tilt amount of the steering roller. This allows to suppress the belt shift and also suppress color misalignment in the main scanning direction. More specifically, for example, the control unit 50 decides the reference moving direction of the intermediate transfer belt 606 and the correction value of the write position on each photosensitive member 608 at the time of movement in the reference moving direction in advance, and modifies the correction value decided in advance based on the difference between the reference moving direction and the actual moving direction. This arrangement enables to suppress color misalignment by easy control.

Note that the pattern images of the respective colors are formed on the intermediate transfer belt 606, and the pattern detection sensor 620 detects the relative positional shift between the formed pattern images in the main scanning direction. When the direction when the pattern images of the respective colors are formed is defined as the reference moving direction, and a correction value is obtained from the relative positional shift at that time, the reference moving direction and the correction value can easily be obtained.

In addition, the relationship between the time and the moving direction of the intermediate transfer belt 606 at the time of non-steering control is obtained in advance. When performing non-steering control, the actual moving direction of the intermediate transfer belt 606 is determined in consideration of the relationship between the time and the moving direction as well. This arrangement allows to more accurately suppress color misalignment. Note that as for the relationship between the time and the moving direction of the intermediate transfer belt 606 at the time of non-steering control, first, non-steering control is performed, and the pattern images of the respective colors are formed on the intermediate transfer belt 606. After that, the relative positional shift between the formed pattern images in the main scanning direction is detected by the pattern detection sensor 620. This enables to easily obtain the relationship between the time and the moving direction of the intermediate transfer belt 606.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2011-253136 filed on Nov. 18, 2011 and 2012-241107 filed Oct. 31, 2012, which are hereby incorporated by reference herein in their entirety.

What is claimed is:

1. An image forming apparatus comprising:

an image forming unit including a plurality of photosensitive members to be driven rotatably, a belt driving unit configured to rotatably drive an endless transfer belt looping over a plurality of rollers including a steering roller and a driving roller, an exposure unit configured to form a latent image on each of the plurality of photosensitive members, a developing unit configured to form a toner image on each of the plurality of photosensitive members by developing, by a toner, the latent image formed by the exposure unit, and a transfer unit configured to transfer the toner image to the transfer belt and to transfer the toner image, which is transferred to the transfer belt, to a printing material, thereby forming an image on the printing material;

a belt position detection unit configured to detect a position of the transfer belt in a rotating shaft direction of the driving roller;

a roller driving unit configured to tilt the steering roller to control the position of the transfer belt in the rotating shaft direction of the driving roller;

a storage unit configured to store a reference position of the steering roller and a reference position of the transfer belt; and a control unit configured to control a formation position of the latent image, in a rotation axis direction of each photosensitive member, formed on each of the plurality of photosensitive members by the image forming unit based on a position of the transfer belt detected by the belt position detection unit, in the rotating shaft direction of the driving roller, with respect to the reference position of the transfer belt and a tilt amount of the steering roller controlled by said roller driving unit with respect to the reference position of the steering roller.

2. The apparatus according to claim 1, wherein said storage unit is further configured to store data representing a correction value of the formation position of the latent image, in the rotation axis direction, on each photosensitive member by said image forming unit when, for each photosensitive member, the position of the transfer belt in the rotating shaft direction of the driving roller is the reference position of the transfer belt, and the tilt amount of the steering roller tilted by said roller driving unit has a tilt amount reference value, and wherein said control unit is further configured to control, in the rotation axis direction, the formation position of the latent image formed on each of the plurality of photosensitive members by said image forming unit by modifying the correction value based on a difference between the reference position of the transfer belt and the position detected by said belt position detection unit and a difference between the tilt amount reference value and the tilt amount of the steering roller.

3. The apparatus according to claim 2, further comprising a pattern detection sensor configured to detect a relative position of a pattern image formed on each of the plurality of photosensitive members and transferred to the transfer belt by said image forming unit, wherein the reference position of the transfer belt is an average value of the positions, in the rotating shaft direction of the driving roller, of the transfer belt detected by said belt position detection unit when the pattern images are formed, the tilt amount reference value of the steering roller is an average value of the tilt amounts of the steering roller when the pattern images are formed, and the correction value is a value obtained from a relative positional shift amount, in the rotating shaft direction of the driving roller, of the pattern images detected by said pattern detection sensor.

4. The apparatus according to claim 1, wherein said storage unit is further configured to store, for each photosensitive member, a value representing a reference moving direction of the transfer belt and data representing the correction value of the formation position of the latent image, in the rotation axis direction, on each photosensitive member by the image forming unit when the transfer belt is moving in the reference moving direction, and wherein said control unit is further configured to control the formation position of the latent image formed on each of the plurality of photosensitive members by said image forming unit by modifying the correction value based on a difference between a value representing a moving direction of the transfer belt and the value representing the reference moving direction.

5. The apparatus according to claim 4, further comprising a pattern detection sensor configured to detect a relative position of a pattern image formed on the transfer belt by each photosensitive member, wherein the reference moving direction is the moving direction of the transfer belt when the pattern images are formed, and the correction value is a value obtained from a relative positional shift amount, in the rotating shaft direction of the driving roller, of the pattern images detected by said pattern detection sensor.

6. The apparatus according to claim 5, wherein said storage unit is further configured to store a value representing a relationship between a time and the moving direction of the transfer belt when an operation of tilting the steering roller is performed, and wherein said control unit is further configured to use, when performing an operation of correcting the moving direction of the transfer belt, the relationship between the time and the moving direction of the transfer belt to determine the moving direction of the transfer belt.

7. The apparatus according to claim 6, wherein the relationship between the time and the moving direction of the transfer belt is obtained by causing said pattern detection sensor to detect a position, in the rotating shaft direction, of each pattern image formed on the transfer belt by each photosensitive member when an operation affecting the moving direction of the transfer belt is performed.

* * * * *